US009062844B2

(12) United States Patent
Saito

(10) Patent No.: US 9,062,844 B2
(45) Date of Patent: Jun. 23, 2015

(54) VEHICULAR LAMP

(71) Applicant: Junichi Saito, Shizuoka (JP)

(72) Inventor: Junichi Saito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 137 days.

(21) Appl. No.: 13/794,373

(22) Filed: Mar. 11, 2013

(65) Prior Publication Data

US 2013/0265790 A1 Oct. 10, 2013

(30) Foreign Application Priority Data

Mar. 14, 2012 (JP) ..... 2012-056822

(51) Int. Cl.
*F21S 8/10* (2006.01)

(52) U.S. Cl.
CPC ..... *F21S 48/1241* (2013.01); *F21S 48/115* (2013.01); *F21S 48/215* (2013.01); *F21S 48/2237* (2013.01); *F21S 48/2268* (2013.01); *F21S 48/2287* (2013.01); *F21S 48/24* (2013.01)

(58) Field of Classification Search
CPC ... F21S 48/115; F21S 48/1241; F21S 48/215; F21S 48/2237; F21S 48/2268; F21S 48/2287; F21S 48/24
USPC ..... 362/511
See application file for complete search history.

(56) References Cited

U.S. PATENT DOCUMENTS 7,946,743 B2 * 5/2011 Natsume et al. ..... 362/511
8,303,146 B2 * 11/2012 Kazaoka et al. ..... 362/511

FOREIGN PATENT DOCUMENTS

JP 2009-146722 A 7/2009

* cited by examiner

*Primary Examiner* — Stephen F Husar
(74) *Attorney, Agent, or Firm* — DLA Piper LLP (US)

(57) ABSTRACT

A clearance lamp (20) including a light source (21) and a light guide (23) that allows light from the light source (21) to enter from an end face of the light guide (23) and emits the light forward from an emitting surface (23*b*) while guiding the light in the interior of the light guide (23). The emitting surface (23*b*) extends along a direction in which the light guide (23) extends. The light guide (23) includes steps (23*c*) that reflect the light traveling through the light guide toward the emitting surface (23*b*), and it further includes a light-emitting surface (23*d*) that is formed at a position different from a position of the light-emitting surface (23*b*) and emits the light traveling through the light guide to the outside of the light guide.

7 Claims, 3 Drawing Sheets

VEHICULAR LAMP

BACKGROUND OF THE INVENTION

1. Field of the Invention

The present invention relates to a vehicular lamp provided with a light guide and more particularly to a vehicular lamp that includes a clearance lamp having a light guide.

2. Description of the Related Art

In a conventionally known combination headlamp, a low-beam lamp, a high-beam lamp, a clearance lamp, and the like are integrally accommodated inside the lamp chamber. In this combination headlamp, for example, a projector-type lamp or a reflector-type lamp is used as the low-beam lamp and the high-beam lamp. As the clearance lamp, a reflector-type lamp has been generally employed. In recent years, there has been proposed a clearance lamp that includes a light guide, in which the light guide allows light emitted from the light source such as an LED (Light Emitted Diode) to enter from an end face of the light guide and then emits the light to the outside of the light guide while guiding the light in the interior of the light guide (see Japanese Patent Application Laid-Open (Kokai) No. 2009-146722, for example).

In the vehicular lamp that uses such a light guide, light distribution is generally controlled so that though the intense light is radiated forward of the light guide, only a small amount of light is diffused upward, downward, leftward, and rightward of the light guide. Therefore, the light guide appears dark when pedestrians or the like see the lamp from the directions other than the front, and thus the visibility of the vehicular lamp tends to be low.

BRIEF SUMMARY OF THE INVENTION

The present invention is devised in the light of the above circumstance, and it is an object of the present invention to provide an art for improving visibility of a vehicular lamp that uses a light guide for emitting light.

In order to solve the above problems with conventional lamps, a vehicular lamp according to one aspect of the present invention includes a light source mounting portion on which a light source is mounted, and a light guide that allows light from the light source to enter from an end face thereof and emits the light forward from its emitting surface (that extends along a direction in which the light guide extends) while guiding the light in the interior of the light guide; and in this structure, the light guide is formed with steps that reflect light traveling through the light guide toward the emitting surface and further with a light-emitting surface at a position different from the position where the emitting surface is provided. The light-emitting surface emits the light traveling through the light guide to the outside of the light guide.

According to the structure above, the light is emitted to the outside of the light guide not only from the emitting surface but also from the light-emitting surface. Therefore, the vehicular lamp has an improved visibility.

The above-described light-emitting surface of the the light guide may be formed by embossing a portion of a peripheral surface of the light guide.

The vehicular lamp according to the present invention may further include a first reflecting portion that reflects at least a part of the light emitted from its light-emitting surface in a direction toward the light guide. The first reflecting portion can be embossed.

The vehicular lamp of the present invention may further include a second reflecting portion that reflects a part of the light reflected by the first reflecting portion in a direction toward the light guide. The second reflecting portion can be embossed as well.

As seen from the above, according to the present invention, it is possible to improve the visibility of a vehicular lamp that includes a light guide for emitting the light forward.

DETAILED DESCRIPTION OF THE INVENTION

An embodiment of the present invention will be described in detail below with reference to the accompanying drawings.

Figure 1:
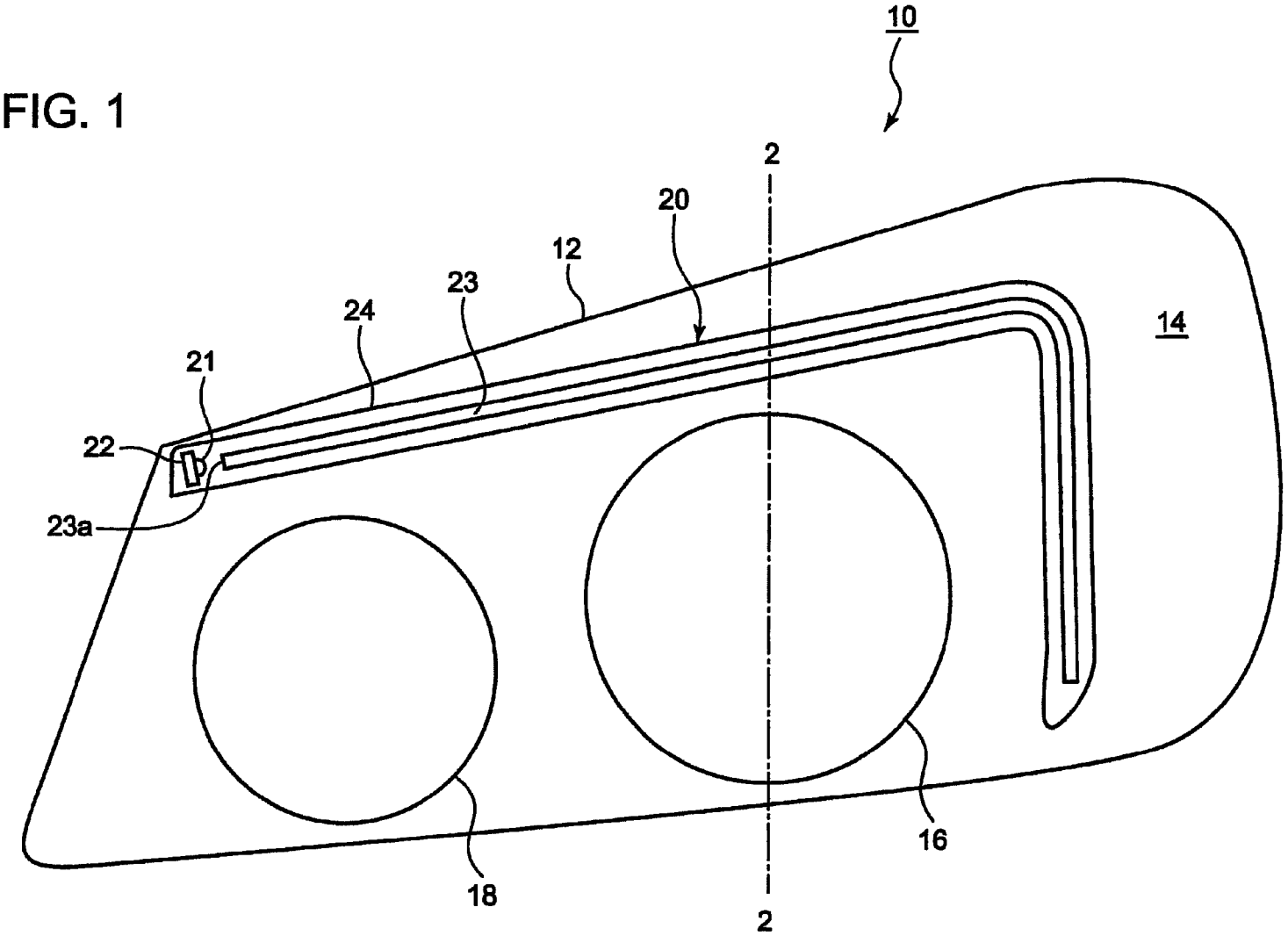
FIG. 1 is a schematic front view illustrating a vehicular lamp particularly a headlamp according to one embodiment of the present invention.
Figure 2:
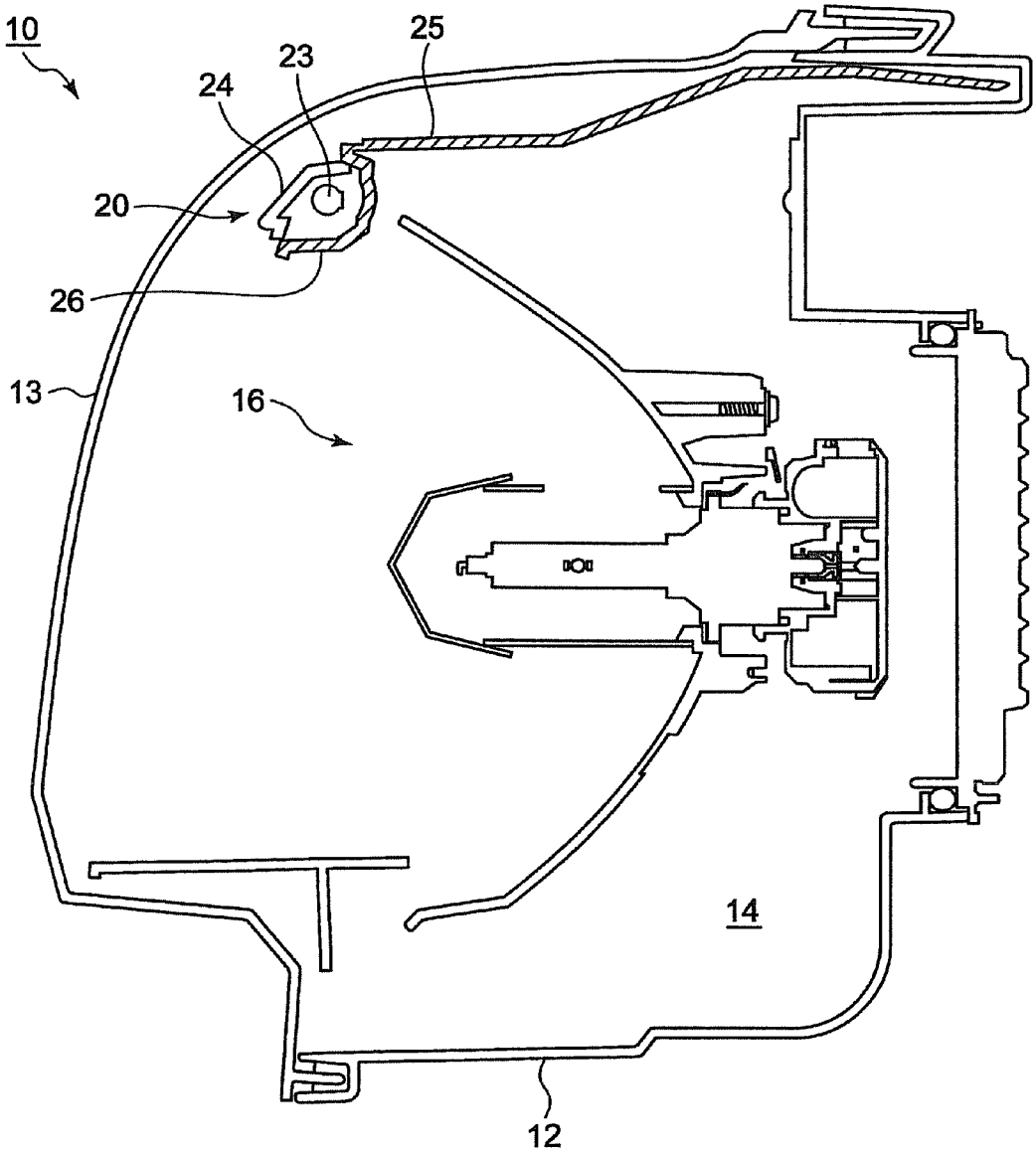
FIG. 2 is a sectional view of the vehicular headlamp taken along the line 2-2 shown in FIG. 1.

FIG. 1 illustrates a vehicular headlamp 10 according to the embodiment of the present invention, and FIG. 2 shows in cross section the vehicular headlamp 10 taken along the line 2-2 in FIG. 1.

As shown in FIG. 1 and FIG. 2, the vehicular lamp 10 is a combination headlamp in which a low-beam lamp 16, a high-beam lamp 18, and a clearance lamp 20 are accommodated inside the lamp chamber 14. The lamp chamber 14 is formed by a lamp body 12 and a transparent cover 13.

The low-beam lamp 16 and the high-beam lamp 18 are provided side-by-side in a vehicle-width direction within the lamp chamber 14. In FIG. 2, the low-beam lamp 16 is a reflector-type lamp. However, the type of the low-beam lamp 16 is not particularly limited, and it can be, for example, a reflector-type or projector-type vehicular lamp. The reflector-type low-beam lamp is publicly known, and a detailed description thereof is omitted here. The type of the high-beam lamp 18 is also not particularly limited, and it can be, for example, a reflector-type or projector-type vehicular lamp.

As shown in FIG. 1 and FIG. 2, the clearance lamp 20 includes an LED 21, a board 22 on which the LED 21 is mounted, a light guide 23, an inner lens 24, and an extension 25.

The light guide 23 is a bar-shaped member formed by injection-molding transparent resin such as acrylic and polycarbonate. The light guide 23 is molded in an L shape as seen from FIG. 1, and it extends in a generally L-shape from one upper end portion (upper left corner in FIG. 1) of the lamp body 12 to a lower end portion of one side (right side in FIG. 1) in a vehicle-width direction of the lamp body 12. An end face of the light guide 23 serves as an incident surface **23*a* through which light from the LED 23 enters. While guiding the light entered from the incident surface 23*a* into the interior of the light guide 23, the light guide 23 emits the light forward from an emitting surface extending along a direction in which the light guide 23** extends.

The LED 21 is a light source that provides light to the light guide 23. The LED 21 is mounted on the board 22 so as to face the incident surface **23*a* of the light guide 23**.

The extension 25 is provided in order to cover the gap between the low-beam lamp 16 and the lamp body 12 and the gap between the high-beam lamp 18 and the lamp body 12. The extension 25 is a resin-molded body. The surface of the extension 25 is treated by an aluminum deposition. As shown in FIG. 2, the front end portion of the extension 25 is formed into a vessel-like shape and has an opening on its front side. The vessel-like front end portion of the extension 25 serves as a lamp body of the clearance lamp 20 and accommodates therein the light guide 23 (such front end portion thus hereinafter being referred to as a "clearance lamp body 26"). The inner lens 24 is provided to cover the opening on the front side of the clearance lamp body 26, and the inner lens 24 and the clearance lamp body 26 form a lamp chamber 27. The inner lens 24 and the clearance lamp body 26 extend so as to follow the shape of the light guide 23.

Figure 3:
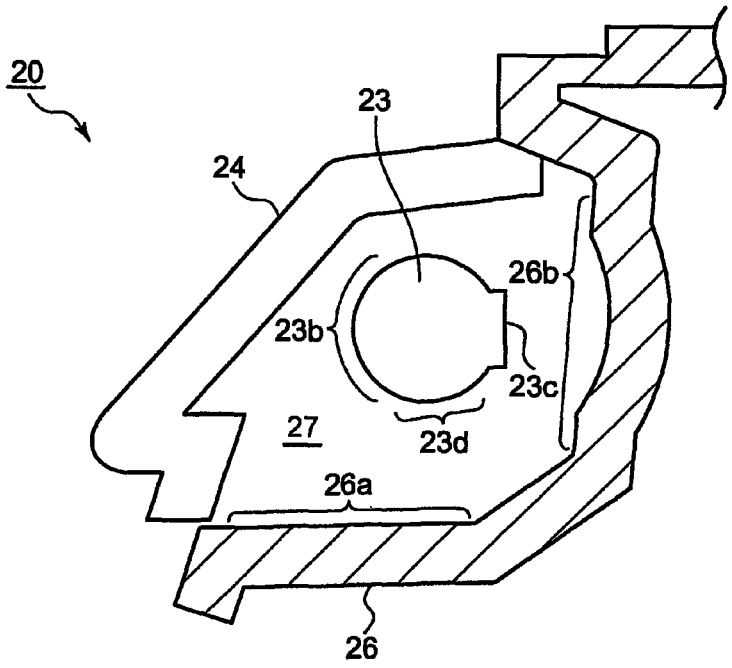
FIG. 3 is an enlarged sectional view of a clearance lamp provided in a a vehicular headlamp of the present invention.

FIG. 3 is an enlarged vertical cross-sectional view of the clearance lamp 20. As shown in FIG. 3, the light guide 23 is positioned at generally the center of the lamp chamber 27. The light guide 23 has a generally circular section, and the inner lens 24 and the clearance lamp body 26 respectively take a polygonal shape in cross-section. In the shown embodiment, the design of the outer shape of the clearance lamp 20 is expressed by the inner lens 24, and the light guide 23 has a relatively small diameter; and as a result, it is possible to achieve, at low cost, a configuration that appears as if a prism body emits light.

In the shown embodiment, a portion on the front side of the peripheral surface of the light guide 23 serves as an emitting surface 23*b* that emits light forward of the lamp. In a portion on the rear side of the peripheral surface of the light guide 23, a plurality of steps 23*c* are formed along the direction in which the light guide 23 extends (or in which a letter L is drawn, so that the steps 23*c* reflect a part of the light traveling through the light guide 23 toward the emitting surface 23*b*. The shape, size, arrangement pitch (or gaps between the steps), and the like of the steps 23*c* are designed so that light with the intensity required for the clearance lamp is emitted from the emitting surface 23*b* toward the front (forward).

A portion of the peripheral surface of the light guide 23 located at a position different from the positions of the emitting surface 23*b* and the steps 23*c* serves as a light-emitting surface 23*d*. The light-emitting surface 23*d* emits the light traveling through the light guide 23 to the outside of the light guide. The light-emitting surface 23*d* is formed by embossing a portion of the peripheral surface of the light guide 23. In the shown embodiment, the light-emitting surface 23*d* is formed by roughening a portion on the lower side of the peripheral surface of the light guide 23, in other words, a portion of the peripheral surface of the light guide 23 that faces the clearance lamp body 26, by embossing. Among the light traveling through the light guide 23, at least a part of the light entering the light-emitting surface 23*d* is emitted to the outside of the light guide 23 without internal reflection.

A portion of the interior bottom surface of the clearance lamp body 26 that faces the light guide 23 is treated with an aluminum deposition and serves as a reflecting portion that reflects at least a part of light emitted from the light-emitting surface 23*d* of the light guide 23 in a direction toward the light guide 23 (such portion thus hereinafter being referred to as a "first reflecting portion 26*a*"). The first reflecting portion 26*a* is also roughened by embossing.

A rear surface portion of the clearance lamp body 26 that faces the light guide 23 is also treated with an aluminum deposition and extends in a direction generally orthogonal to the first reflecting portion 26*a* and also serves as a reflecting portion that further reflects a part of light reflected by the first reflecting portion 26*a* in the direction toward the light guide 23 (such rear surface portion thus hereinafter being referred to as a "second reflecting portion 26*b*"). The second reflecting portion 26*b* is also roughened by embossing.

Figure 4:
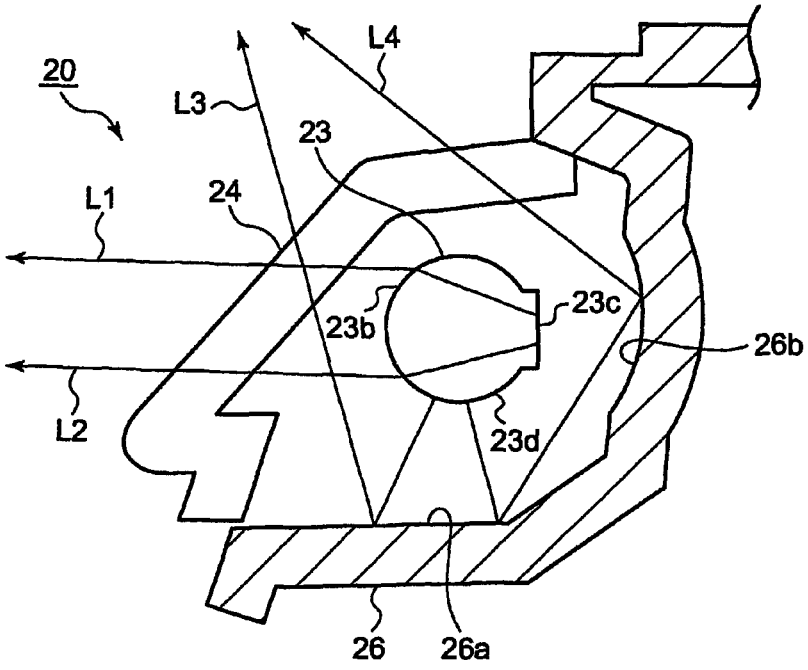
FIG. 4 is a view showing how light is emitted from the clearance lamp of FIG. 3.

FIG. 4 shows how the light of the LED 21 is emitted from the clearance lamp 20. In the clearance lamp 20, when the LED 21 is supplied with current, light is emitted from the LED 21, and this light emitted from the LED 21 enters the light guide 23 from the incident surface 23*a* (see FIG. 1 for the incident surface 23*a*). The light that entered the light guide 23 travels through the light guide 23 while repeating total reflection.

While the light travels through the light guide 23, light entering each of the steps 23*c* provided in the rear surface of the light guide 23 is reflected by the steps 23*c* toward the emitting surface 23*b* and is emitted from the emitting surface 23*b*. Thus, when such reflection occurs in the plurality of steps 23*c* formed along the direction in which the light guide 23 extends, light is emitted from substantially the entire region of the emitting surface 23*b* that extends along the direction in which the light guide 23 extends. The light emitted from the emitting surface 23*b* advances forward of the lamp, passing through the inner lens 24 (see the light rays L1 and L2 in FIG. 4).

Meanwhile, while the light that entered the light guide 23 travels through the light guide 23, a part of the light emitted from the light-emitting surface 23*d* provided in the lower surface of the light guide 23 is reflected upward by the first reflecting portion 26*a*. As described above, because the first reflecting portion 26*a* is roughened by embossing, the light that entered the first reflecting portion 26*a* is diffusely reflected, and this light reflected by the first reflecting portion 26*a* is emitted upward of the lamp through the inner lens 24 (see the light ray L3 in FIG. 4).

In addition, while the light that entered the light guide 23 travels through the light guide 23, another part of light emitted from the light-emitting surface 23*d* provided in the lower surface of the light guide 23 is reflected by the first reflecting portion 26*a* toward the second reflecting portion 26*b*, and the light reflected by the first reflecting portion 26*a* is further reflected by the second reflecting portion 26*b*. As described above, because the second reflecting portion 26*b* is roughened by embossing, the light that entered the second reflecting portion 26*b* is diffusely reflected, and this light reflected by the second reflecting portion 26*b* is emitted upward of the lamp through the inner lens 24 (see the light ray L4 in FIG. 4).

As described above, in the clearance lamp 20 of the shown embodiment, light can be radiated forward of the clearance lamp 20 as well as upward of the clearance lamp 20. Therefore, it is possible to improve the visibility of the clearance lamp 20 from above and to appropriately alert the pedestrians and the like to the presence of a vehicle mounted with the lamp of the present invention.

In the shown embodiment, because the first reflecting portion 26*a* and the second reflecting portion 26*b* are embossed, light can not only be emitted in a certain direction but also be diffusely emitted in various directions. Therefore, it is possible to improve the visibility regardless of the position or the angle from or at which the clearance lamp 20 is viewed.

In the above-described embodiment, an LED is used as a light source of the clearance lamp 20. However, other light sources such as light bulbs can be used. The shape of the light guide 23 is not particularly limited, and light guides having various shapes can be employed.

The above-described embodiment has a configuration that the light-emitting surface 23*d* is formed in the lower surface of the light guide 23, and the light emitted from the light-emitting surface 23*d* is reflected by the first reflecting portion 26*a* and the second reflecting portion 26*b* and emitted upward. In addition to this configuration or instead of this configuration, a light-emitting surface can be formed by embossing the upper surface of the light guide 23, that is, a portion of the peripheral surface of the light surface 23 that faces the inner lens 24. In this structure, the light emitted from the light-emitting surface is directly emitted upward of the lamp through the inner lens.

In the above-described embodiment, the present invention is described as an example of a clearance lamp. However, the present invention is applicable to other vehicular lamps that use light guides instead of clearance lamps.

The present invention is described based on the embodiments. These embodiments are examples of the present invention. It should be understood by persons skilled in the art that modifications of components and processes are possible and such modifications are within the scope of the present invention.

The invention claimed is:

1. A vehicular lamp comprising:

a light source mounting portion on which a light source is mounted;

a light guide for allowing light from the light source to enter from an end face of the light guide and emitting the light forward from an emitting surface thereof while guiding the light in an interior thereof, the emitting surface extending along a direction in which the light guide extends, wherein the light guide is formed with:

steps that reflect light traveling through the light guide toward the emitting surface; and a light-emitting surface formed at a position different from a position of the emitting surface, the light-emitting surface emitting the light traveling through the light guide to an outside of the light guide; and a first reflecting portion for reflecting at least a part of the light, which is emitted from the light-emitting surface of the light guide, toward the light guide.

2. The vehicular lamp according to claim 1, wherein the light-emitting surface is formed by embossing a portion of a peripheral surface of the light guide.

3. The vehicular lamp according to claim 1, wherein the first reflecting portion is embossed.

4. The vehicular lamp according to claim 1, further comprising a second reflecting portion for reflecting a part of light, which is reflected by the first reflecting portion, toward the light guide.

5. The vehicular lamp according to claim 4, wherein the second reflecting portion is embossed.

6. The vehicular lamp according to claim 3, further comprising a second reflecting portion for reflecting a part of light, which is reflected by the first reflecting portion, toward the light guide.

7. The vehicular lamp according to claim 6, wherein the second reflecting portion is embossed.

* * * * *